US007159451B2

(12) United States Patent
McGann et al.

(10) Patent No.: US 7,159,451 B2
(45) Date of Patent: Jan. 9, 2007

(54) SYSTEMS AND METHODS FOR FITTING GOLF EQUIPMENT

(76) Inventors: Timothy J. McGann, P.O. Box 2369, Del Mar, CA (US) 92014-1669; Mitchell Clark Voges, 237 Rangely Ct., Simi Valley, CA (US); Daniel Patrick Hollister, 27451 Silver Oak La. #2031, Santa Clarita, CA (US) 91387

( * ) Notice: Subject to any disclaimer, the term of this patent is extended or adjusted under 35 U.S.C. 154(b) by 0 days.

(21) Appl. No.: 10/722,585

(22) Filed: Nov. 26, 2003

(65) Prior Publication Data

US 2005/0085309 A1 Apr. 21, 2005

Related U.S. Application Data

(63) Continuation-in-part of application No. 10/053,797, filed on Jan. 18, 2002.

(51) Int. Cl.
*A63B 53/00* (2006.01)

(52) U.S. Cl. ..... 73/65.03

(58) Field of Classification Search ..... 73/491, 73/12.04, 65.01–65.09; 473/407, 131, 199, 473/152, 266

See application file for complete search history.

(56) References Cited

U.S. PATENT DOCUMENTS

| | | | |
|---|---|---|---|
| 1,167,106 | A | 1/1916 | Palmer |
| 3,717,857 | A | 2/1973 | Evans |
| 3,945,646 | A | 3/1976 | Hammond |
| 3,963,236 | A | 6/1976 | Mann |
| 4,059,270 | A | 11/1977 | Sayers |
| 4,094,072 | A | 6/1978 | Erb |
| 4,214,754 | A | 7/1980 | Zebelean |
| 4,432,549 | A | 2/1984 | Zebelean |
| 4,869,507 | A | 9/1989 | Sahm |
| 4,885,847 | A | 12/1989 | Korfanta |
| 5,004,241 | A | 4/1991 | Antonious |
| 5,067,719 | A | 11/1991 | Mook |
| 5,078,398 | A | 1/1992 | Reed et al. |
| 5,133,556 | A | 7/1992 | Karasavas |
| 5,244,210 | A | 9/1993 | Au |
| 5,257,807 | A | 11/1993 | Baumann et al. |
| 5,335,909 | A | 8/1994 | Green, Jr. |
| 5,429,365 | A | 7/1995 | McKeighen |
| 5,447,309 | A | 9/1995 | Vincent |
| 5,459,793 | A | 10/1995 | Naoi et al. |
| 5,478,073 | A | 12/1995 | Hackman |
| 5,616,832 | A | 4/1997 | Nauck |
| 5,755,624 | A | 5/1998 | Helmstetter |

(Continued)

OTHER PUBLICATIONS

International Search Report for PCT/US06/02390.

*Primary Examiner*—Michael Cygan
*Assistant Examiner*—Octavia Davis

(57) ABSTRACT

A golf equipment fitting system that uses advanced technology to not only objectively identify the optimum equipment for the golfer, but to also identify and help correct swing flaws so that the golfer can achieve optimum performance on the golf course. Thus, in one embodiment, golf fitting includes collecting data related to the golfer's swing and determining if the golfer's swing technique should be modified based at least in part on the collected swing data. When it is determined that the golfer's swing technique should be modified, then providing swing instruction to the golfer. When, however, it is determined that the golfer's swing technique is fine, then collecting data related to how the golfer's swing launches a golf ball. Finally, golf equipment, e.g., golf clubs, can be specified based on the collected swing data and launch data.

31 Claims, 14 Drawing Sheets

U.S. PATENT DOCUMENTS 5,779,556 A 7/1998 Cervantes et al.
5,792,000 A 8/1998 Weber et al.
5,821,417 A 10/1998 Naruo et al.
5,884,409 A 3/1999 Muldoon
5,911,636 A * 6/1999 Schmoll ..... 473/266
5,916,041 A 6/1999 Antonious
5,947,840 A 9/1999 Ryan
5,984,804 A 11/1999 Berg
6,001,495 A 12/1999 Bristow et al.
6,042,483 A * 3/2000 Katayama ..... 473/199
6,050,904 A 4/2000 Kuo
6,213,888 B1 4/2001 Kawaguchi et al.
6,224,493 B1 5/2001 Lee et al.
6,273,828 B1 8/2001 Wood et al.
6,290,607 B1 9/2001 Gilbert et al.
6,305,063 B1 10/2001 Ashcraft et al.
6,306,048 B1 10/2001 McCabe et al.
6,331,149 B1 12/2001 Mikame et al.
6,334,817 B1 1/2002 Ezawa et al.
6,390,934 B1 5/2002 Winfield et al.
6,398,670 B1 * 6/2002 Engelhardt et al. ..... 473/407
6,425,832 B1 7/2002 Cackett et al.
6,431,990 B1 8/2002 Manwaring
6,488,594 B1 12/2002 Card et al.
6,506,129 B1 1/2003 Chen
6,533,674 B1 * 3/2003 Gobush ..... 473/199
6,595,128 B1 7/2003 Parks
6,692,382 B1 * 2/2004 Adams et al. ..... 473/387
6,758,759 B1 * 7/2004 Gobush et al. ..... 473/131
6,834,129 B1 * 12/2004 Asakura ..... 382/289
2002/0032076 A1 3/2002 Isogawa et al.
2002/0077189 A1 6/2002 Tuer et al.
2002/0173367 A1 * 11/2002 Gobush et al. ..... 473/197
2003/0008731 A1 1/2003 Anderson et al.
2004/0030527 A1 * 2/2004 Rankin ..... 702/153
2005/0079932 A1 * 4/2005 Voges et al. ..... 473/407

* cited by examiner

| | | | | | | | | | | |
|---|---|---|---|---|---|---|---|---|---|---|
| 1 | 44.8 | 1.92 | 1.71 | 5.2 | | 0.0 | 0 | 0.0 | 0.0 | 0.0 |
| 2 | 43.4 | 1.86 | 1.68 | 4.9 | | 0.0 | 0 | 0.0 | 0.0 | 0.0 |
| 3 | 43.6 | 1.83 | 1.51 | 4.8 | | 0.0 | 0 | 0.0 | 0.0 | 0.0 |
| 4 | 42.0 | 1.90 | 1.51 | 5.1 | | 0.0 | 0 | 0.0 | 0.0 | 0.0 |
| 5 | 46.8 | 2.17 | 1.94 | 6.2 | | 0.0 | 0 | 0.0 | 0.0 | 0.0 |
| AVG | 44.1 | 1.94 | 1.67 | 5.2 | | 0.0 | 0 | 0.0 | 0.0 | 0.0 |

SYSTEMS AND METHODS FOR FITTING GOLF EQUIPMENT

RELATED APPLICATION INFORMATION

The present application claims priority as a continuation in part under 35 U.S.C. ¶120 to U.S. patent application Ser. No. 10/053,797, entitled "Golf Club Woods With Wood Club Head Having a Selectable Center of Gravity and a Selectable Center of Gravity and a Selectable Shaft," filed Jan. 18, 2002, which is incorporated herein by reference in its entirety.

BACKGROUND

1. Field of the Inventions

The field of the invention relates generally to the fitting of golf equipment and more particularly to systems and methods designed to improve the golfer's swing and provide more precise club fitting.

2. Background Information

Systems and method for fitting golf equipment to a specific golfer are well known. The goal of such conventional club fitting techniques is to help improve a particular golfer's game by providing him with equipment that is suited for his particular swing. Conventional club fitting methods are often based on swing parameters that are poor metrics for defining the golfer's overall swing and equipment needs. For example, conventional fitting methods are often based primarily on club speed as measured by a swing speed gauge. Club speed alone, however, can result in poor club fitting, because club speed is not always a good metric for defining a golfer's equipment needs.

For example, two golfers can have the same club speed of 100 mph, which will often result in the same club recommendation, including club type, shaft length, shaft flex, and club face loft, when conventional fitting techniques are employed. One of these golfers, however, may launch the golf ball at a 15 degree angle relative to the ground, while the other launches the golf ball at a 3 degree angle. Further, one golfer's swing can result in the golf ball rotating at 5000 rotations per minute (rpm's), e.g., using a driver, while the other generates 2500 rpms. The rotations per minute of the golf ball is often referred to as the spin of the golf ball. Using conventional techniques, both golfers will often end up with the same shaft and loft recommendation. In fact, however, these golfers require very different equipment to achieve optimum results.

Another drawback of conventional fitting techniques is that such techniques fit the golfer as he currently plays without consideration of swing flaws, e.g., in the golfer's posture, grip, etc. Thus, existing techniques can condemn a golfer to a lifetime of inconsistent play, because the golfer is being told to use equipment that does not account for, or that masquerades, the golfer's swing faults. For effective equipment fitting to occur, there has to be a marriage of talent, technique, and technology to help a golfer play to his maximum potential and derive more enjoyment out of the game.

SUMMARY OF THE INVENTION

A golf equipment fitting system uses advanced technology to not only objectively identify the optimum equipment for a golfer, but to also identify and help correct swing flaws so that the golfer can achieve optimum performance on the golf course. In one embodiment, golf fitting includes collecting data related to the golfer's swing and determining if the golfer's swing technique should be modified based at least in part on the collected swing data. When it is determined that the golfer's swing technique should be modified, then providing swing instruction to the golfer. When, however, it is determined that the golfer's swing technique is fine, then data is collected related to how the golfer's swing launches a golf ball. Finally, golf equipment, e.g., golf clubs, can be specified based on the collected swing data and launch data.

These and other features, aspects, and embodiments of the invention are described below in the section entitled "Detailed Description of the Preferred Embodiments."

BRIEF DESCRIPTION OF THE DRAWINGS

Features, aspects, and embodiments of the inventions are described in conjunction with the attached drawings, in which.

DETAILED DESCRIPTION OF THE PREFERRED EMBODIMENTS

The golf equipment fitting process described herein can be implemented as a multi-step evaluation process that can be broadly divided into two phases. The first phase involves an evaluation of a golfer's current golf equipment and swing technique. The steps comprising the first phase require data collection to give discreet information concerning key attributes of the golfer's swing. The swing data gathered during the first phase can be used to identify major swing flaws so that these flaws can be corrected before fitting the golfer with golf equipment. This can result in better fitting of golf equipment, because if not corrected, the swing flaws will lead to inconsistent results regardless of the equipment being used. Moreover, if the golfer is fit for golf equipment based on his flawed swing, the equipment he was fitted with may no longer be appropriate if he later corrects the swing flaws. Thus, correcting swing flaws prior to beginning the club fitting process can result in a more optimized fitting. To this end, the systems and methods described herein can be used to aid in the identification and correction of swing flaws, which can be an integral part of the fitting process described below.

The second phase can involve collecting launch data and, in certain embodiments, combining it with swing data collected in the previous phase in order to fit the player with, optimized equipment including shafts, clubs, and balls.

Figure 1:
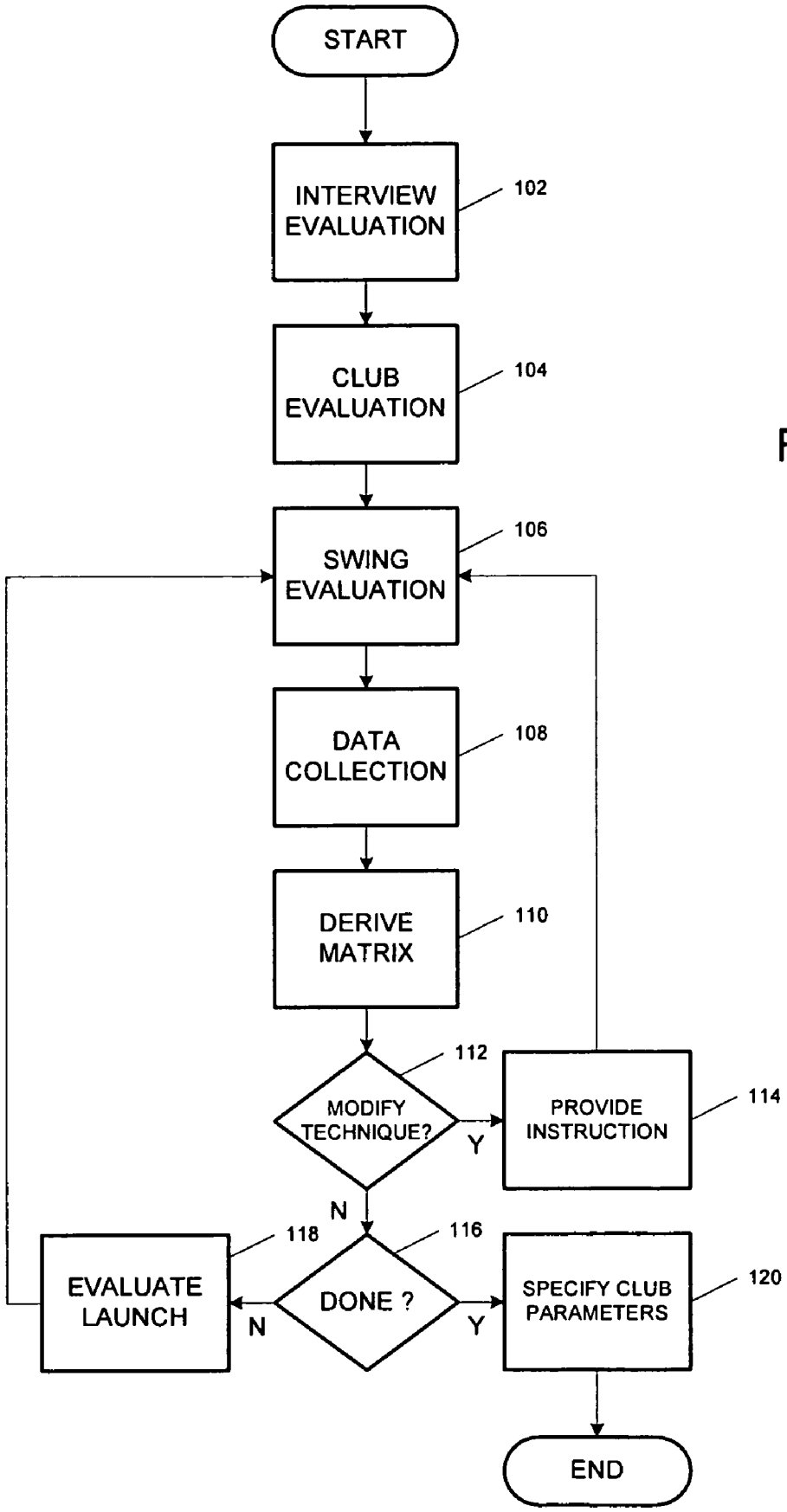
FIG. 1 is a flow chart illustrating an example method for fitting golf equipment in accordance with one embodiment of the invention.

Thus, FIG. 1 is a flow chart illustrating an example method for fitting golf equipment in accordance with one embodiment of the systems and methods described herein. The method of FIG. 1 begins in step 102 where the golfer is interviewed in order to evaluate the current status of his golf game. Step 102 can, for example, include determining through the interview process: what equipment the golfers has been using; what the player considers to be the strengths and weaknesses of his golf game; the courses and conditions the golfer will likely encounter; the level of competition the golfer encounters; and an evaluation of the swing technique of the golfer.

Evaluating the swing technique of the golfer can comprise observing the golfer hit several golf balls. Often, a video system, such as video system 414 described below, is used to help evaluate the golfer's swing technique using, for example, a swing module 412, which is also described in more detail below.

At this point, certain swing flaws can be readily apparent. These swing flaws can, in certain embodiments, be adjusted prior to proceeding. In this case, identification of more subtle swing flaws can occur at a later stage. Alternatively, evaluation of swing technique and identification of swing flaws, no matter how apparent, can wait until swing evaluation, e.g., as described below in relation to step 106.

In step 104, the golfer's current golf clubs are evaluated. This evaluation can, for example, include measuring the flex, lie angle, and loft of the golfer's golf clubs. The flex can be measured using standard flex charts. The lie angle and loft are standard measurements of the golf club. Briefly, however, at address, the club shaft and the ground create an angle called the lie angle. In this position, the club is perfectly square to the target. Another way to describe the lie angle is the angel between the centerline of the golf club shaft and the horizontal grooves on the clubface. The same lie angle does not suit all players. Physical differences, e.g. height, arm-length, etc. can require a different lie angle for one golfer compared to another. Because proper lie angle is essential to achieving consistently solid, accurate shots, it is important to measure the lie angle of the golfer's clubs. If the golfer's lie angle is "toe up," he will tend to hook the ball, and will benefit from a flatter lie angle; if the golfer's lie angle is "toe down," he will have a tendency to slice the ball, and will benefit from a more upright lie angle.

The loft is the angel that the golf club face makes relative to the centerline of the shaft. Adjusting the loft of standard club heads is an important method for compensating for the golfer's tendencies to hit higher or lower trajectories than normal.

Next, in step 106 the golfer's swing is evaluated and data is collected regarding the swing in step 108. This swing data can then be combined, in step 110, with the information gathered in step 102 to generate a baseline performance matrix for the golfer. The performance matrix can be used to help determine if the golfer's swing technique needs modification in step 112. If it is determined that the golfer's technique needs to be modified, then he can be given instruction in step 114. The instruction of step 114 should be designed to achieve specific modifications in the golfer's swing technique that will help the golfer to achieve a more efficient swing. Progress can be closely monitored, e.g., by repeating steps 106–114 as required.

Because the process of FIG. 1 can involve swing technique evaluation and instruction, it can be preferable for steps 102–114 to be carried out by, or with the assistance of, a golf professional. In fact, it can be preferable for the entire golf equipment fitting process to be carried out by a golf professional.

The swing evaluation and data collection of steps 106 and 108 are described in more detail below in relation to the flow chart of FIG. 2.

Once it is determined, in step 112, that the golfer's technique is sufficient; the data collected can be combined with launch data, in step 118, to fit the golfer with optimized equipment including shaft, club, and ball. The launch evaluation of step 118 is described in more detail below in relation to the flow chart of FIG. 3.

The launch evaluation of step 118 can be followed by further swing evaluation (step 106). Alternatively, all swing evaluation steps can be completed prior to the launch evaluation of step 118. In either case, once the swing evaluation, step 106, and launch evolution 118, are completed in step 116, then the resulting information can be used to specify parameters that describe the optimum golf equipment for the golfer in step 120.

Figure 2:
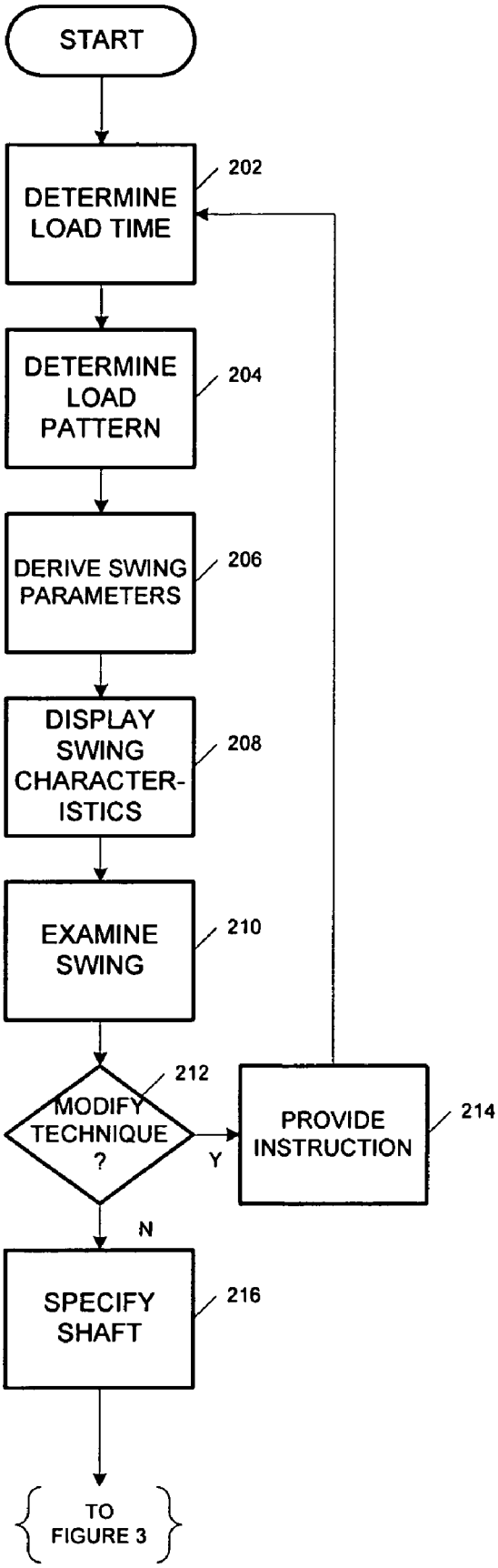
FIG. 2 is a flow chart illustrating an example method for collecting swing data in accordance with the invention.

FIG. 2 is a flow chart illustrating an example method for collecting swing data in accordance with the systems and methods described herein. First, in step 202 data related to the load time for the golfer's swing can be collected. The load time is defined as the time the golfer loads the shaft during his downswing. The loading starts just prior to, or at the top of, the golfer's back swing and ends at impact with the golf ball. The load time provides an indication of how quickly the golfer swings a golf club from the top of his back swing to impact with the golf ball. A load time that is too fast, or too slow tends to be difficult to repeat and can result in many of the typical performance problems that golfers experience. For example, a load time that is too long generally results in a lack of power and inconsistent launch conditions. It has been shown, using the systems and methods described, herein that load time is generally optimized when it falls between 0.45 to 0.50 seconds.

Next, in step 204, data related to the load pattern for the golfer's swing can be collected. The load pattern is defined as the deflection, or load of the golf club shaft as a function of time during the downswing. Different types of load patterns indicate different swing tendencies. For example, a "single crest" load pattern as shown in FIG. 5C indicates a swing where the golfer tends to release his wrist too early. This situation is often referred to as casting, i.e., the golfer is casting the golf club much the same way a fishermen casts a fishing rod. In FIG. 5C, the y-axis corresponds to the deflection in inches, while the x-axis corresponds to time. The point of impact with the golf ball corresponds to the point 506 where the curve touches, or approaches, the x-axis. Thus, in FIG. 5C it can be seen from curve 510 that the golfer loaded the club early in the golf swing, creating significant deflection or load, but then released the load well before impact with the golf ball.

Accordingly, a "single crest" load pattern is sometimes said to indicate that the golfer loads the club too quickly at the initiation of the downswing and then decelerates during the rest of the downswing. A situation that is referred to as an "early load".

Figure 5A:
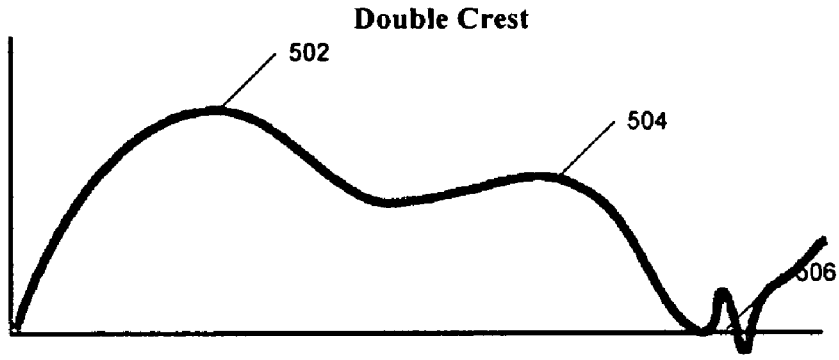
FIG. 5A is a diagram illustrating a double crest load pattern for a golfer's swing as determined by the process of FIG. 2.

A "double crest" load pattern is illustrated in FIG. 5A. A double crest load pattern can indicate a situation where the golfer initiates loading at the start of the downswing, as illustrated by crest 502, and then reloads the club with his wrist just prior to impact, as illustrated by crest 504. This is indicative of a golfer whose swing is not smooth and is typically too long which again makes it difficult to make consistent contact with the golf ball.

Figure 5B:
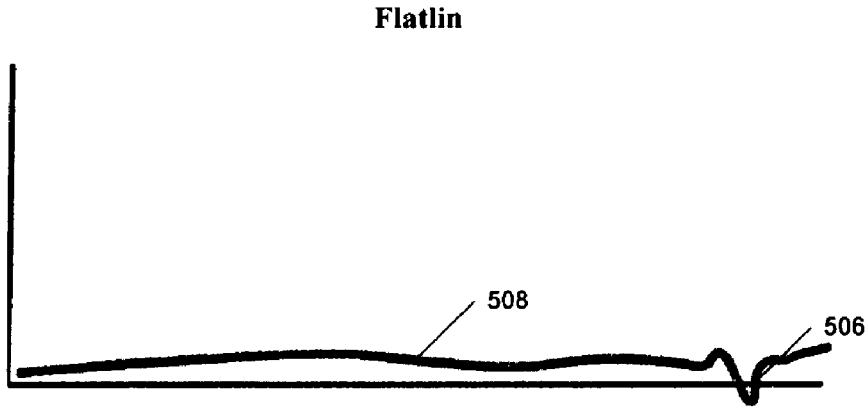
FIG. 5B is a diagram illustrating a flat line load pattern for a golfer's swing as determined by the process of FIG. 2.
Figure 5C:
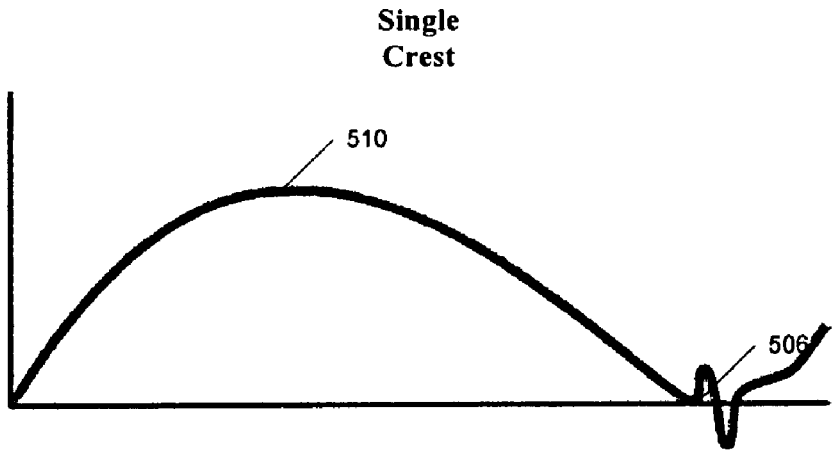
FIG. 5C is a diagram illustrating a single crest load pattern for a golfer's swing as determined by the process of FIG. 2.

A "flat line" load pattern is illustrated in FIG. 5B. The flat line load pattern can indicate a situation where the golfer has little or no significant load during the downswing as illustrated by load pattern curve 508. A golfer with a flat line load pattern does not generate enough energy to deflect the shaft and will not create solid or consistent contact with the golf ball.

Figure 5D:
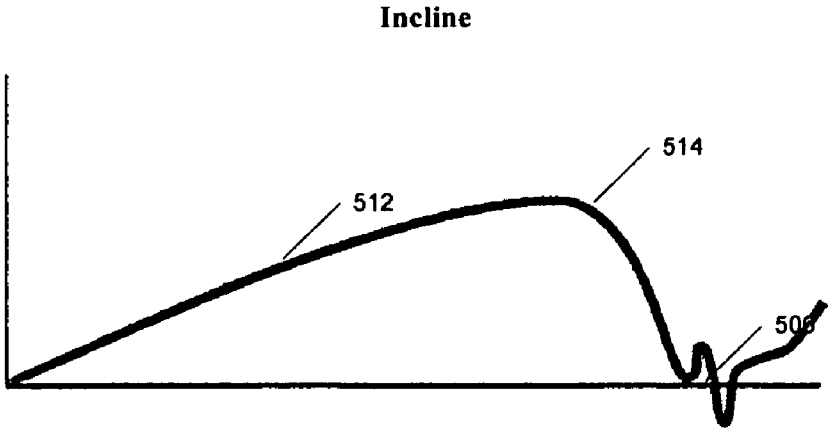
FIG. 5D is a diagram illustrating an incline load pattern for a golfer's swing as determined by the process of FIG. 2.

The "incline" load pattern illustrated in FIG. 5D, on the other hand, is indicative of an optimum load pattern. An incline load pattern is a linear loading, as illustrated by linear portion 512, of the shaft, where the crest load 514 occurs just prior to impact. A swing that results in an incline load pattern makes the most use of the stored energy in the shaft and is therefore the most efficient. Thus, it is preferable for the systems and methods described herein to help modify the golfer's swing and fit him with golf equipment that will generate an incline load pattern swing after swing. In other words, the incline load pattern can be the model for the systems and methods describe herein.

In step 206, swing parameters that define the golfer's swing can be derived from the swing data collected in steps 202 and 204. For example, in one embodiment, a load time can be derived from the load time data collected in step 202. The load time can be an average of the data collected for multiple swings. A peak load, or deflection, can also be derived from the load pattern data collected in step 204. Again the peak load can be averaged over several swings. A swing ramp can also be derived for the golfer. The swing ramp is a measure of the potential energy of the swing and can be measured in miles per hour. Thus, it is similar to the club speed used in conventional techniques.

The data collected in steps 202 and 204, and derived therefrom, can also be used to generate a shaft flex measurement. In other words, the load time, peak load, and swing ramp can be correlated to a standard shaft flex measurement. This measurement can simply be a standard numerical indicator that corresponds to a certain standard shaft flex, i.e., stiff, regular, etc.

The swing parameters derived in step 206 can then be displayed in step 208, e.g., by system 400 described below. For example, the parameters derived in step 206 can be displayed in conjunction with a graph of the load pattern of step 204, i.e., the patterns of FIGS. 5A–5D. The displayed information can then be used to help evaluate the golfer's swing in step 210 and to identify any swing flaws using the information displayed. For example, if the information displayed in step 208 indicates that the golfer has a "single crest" load pattern, then this can be identified in step 212 and instruction can be given to the golfer to correct the early release, or casting, flaw in the golfer's swing.

In certain embodiments, a video system, such as video system 414 can be used in conjunction with the swing data collected in steps 202–206 and displayed in step 208 to analyze the golfer's swing. Such a video system can comprise video, or high-speed cameras oriented, for example, directly behind the golfer and pointed down the target line and/or facing the golfer as he makes his swings. The images of the golfer's swing generated by the video system can then be displayed and can be correlated to the load pattern. Thus, when the load pattern indicates a problem, the swing video can be consulted to help assess the problem and to allow the golfer to visualize the swing flaw and begin working to correct it. Various swing flaws, which result in improper load time and load pattern, can then be corrected in step 214. This process, which is useful in modifying the golfer's technique also results in increased ball speed, appropriate launch angle, and spin rates.

As the golfer works to correct his swing in step 214, steps 202–212 can be repeated until a more optimum swing is achieved. This results in a better swing and a better fitting than conventional fitting techniques, because the golfer swing is improved to the point where he can make better more consistent contact, rather than fitting the golfer for equipment when his swing has flaws that will prevent him from consistently making contact even with his new fitted equipment.

Once the golfer's swing technique is sufficient to proceed with the fitting process, a shaft stiffness recommendation can be obtained from the swing parameters derived in step 208. For example, the swing characteristics derived in step 208 can be used to recommend shaft stiffness for the golfer.

Figure 3:
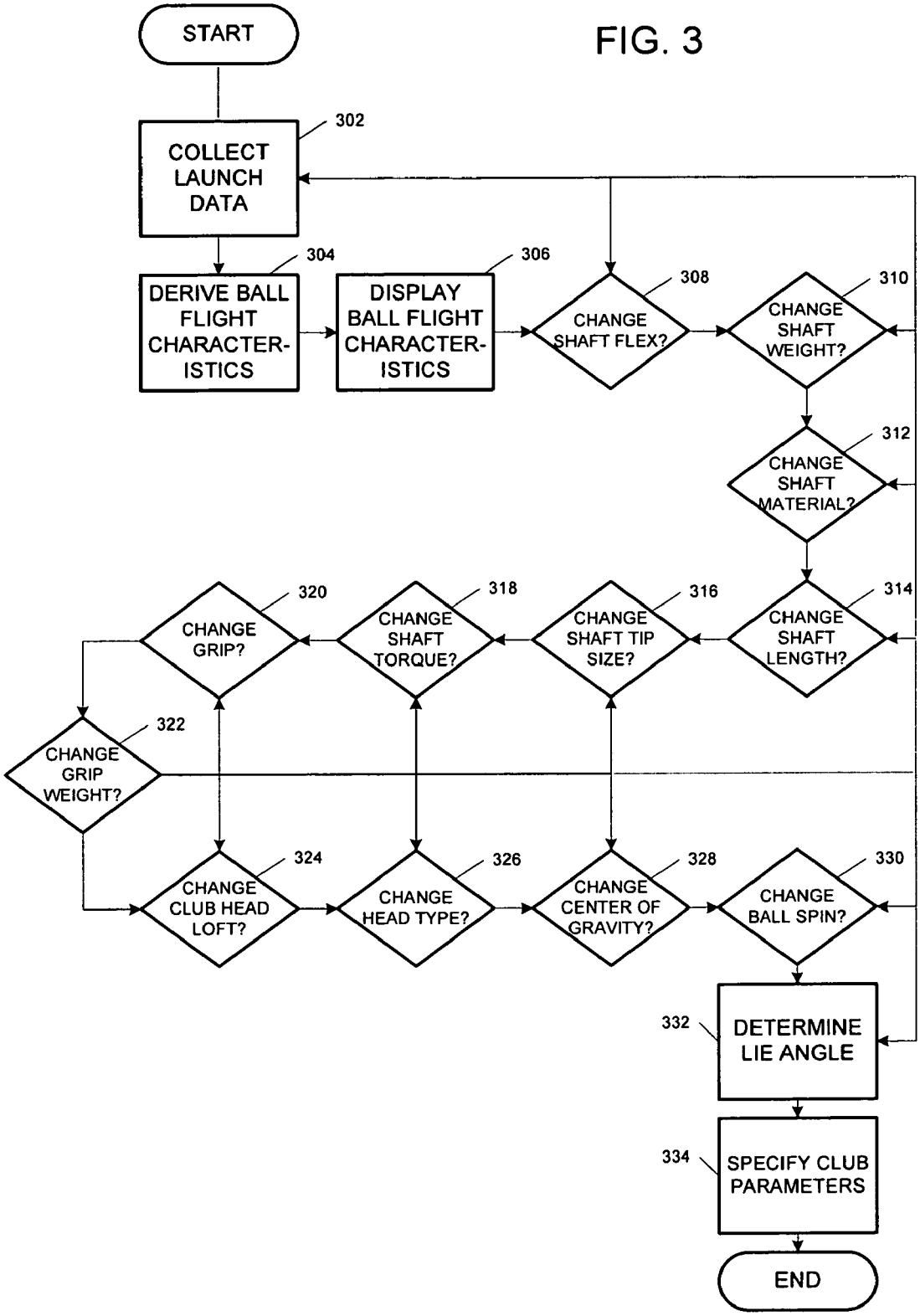
FIG. 3 is a flow chart illustrating an example method for collecting launch data in accordance with one embodiment of the invention.

Once the swing data is collected, the golfer's swing can be examined to determine how he launches a golf ball. FIG. 3 is a flow chart illustrating an example for collecting launch data in accordance with one embodiment of the systems and methods described herein. First, in step 302, launch data can be collected. In one embodiment, launch data is collected for the golfer using the golfer's driver. Launch data can be collected using a high-speed camera system, such as a system 416, focused closely on the golf ball. The golf ball is then marked with particular markings to allow launch data to be derived from the high-speed pictures obtained from the high-speed camera system. Launch data can include, e.g., the initial velocity of the golf ball as it is launched, the spin rate of the golf ball as it is launched, and the launch angle of the golf ball relative to the ground.

The spin rate can include components of backspin, sidespin, and rifle spin, each of which can be calculated depending on the embodiment. The launch angle can also include both components of left/right deviation with the target line and the angle with the horizon.

Once the launch data is collected in step 302, ball flight information can be derived in step 304 for each swing of the golf club. For example, based on the images captured by the high speed camera system, the ball speed, spin, and launch angle can be derived as well as how far the ball would have carried, an estimation of how far the ball would travel all together, i.e., including roll, and a deviation from the center line. The deviation can be measured in degrees right or left of the centerline.

The information derived in step 304 can then be displayed in step 306, e.g., by system 400. For example, not only can the values for the derived information be displayed, e.g., in a table, but a graphical illustration of the ball flight can also be displayed.

The process of FIG. 3 can be started using the golfer's own driver, or other equipment. The data collected can then be used to start fine-tuning the golfer's equipment to achieve the optimum ball flight, including a fine-tuning of the shaft recommendation of step 216 described above. For example, in order to maximize driver distance one needs to match the golfer's ball speed with an optimized combination of launch angle and spin rate. Thus, after the golfer hits golf balls using his own club and data is collected and displayed in steps 302–306, a club with a shaft flex in the range of that recommended in step 216 can be used to obtain and display more date, i.e., steps 302–306 are repeated. The shaft flex can then be fined tuned in step 308, by continuing to use clubs with various shaft flexes until a shaft flex that appears optimal is determined. In addition, different clubs, with various shaft materials, gram weights, tip sections, lengths, torques and can be tested in steps 310–318, and steps 302–306 repeated, until an optimum ball flight is achieved as depicted, for example, by the data displayed in step 306. Various types of grips and grip weights can also be tested in steps 320–322.

It is well known that two different golf clubs can have the same frequency, or flex range, but have entirely different performance characteristics. For example, a shaft can be stiffer in the tip, or stiffer in the butt, when compared to another shaft. Torsional stiffness, or torque, can also play an important part in the overall performance of a golf club. Thus, although two different clubs can be well fitted to the golfer in terms of shaft stiffness, they can produce entirely different launch conditions. By finding the combination of shaft characteristics that maximizes, for example, distance off the tee, the golfer can be properly fitted with the best equipment for his technique. In other words, by continually fine tuning various aspects of the golf shaft to achieve an optimal ball flight, the best equipment for the particular golfer can be identified.

The driver is an important club for every golfer and has some very specific characteristics that may need to be adjusted to obtain the best driver performance for a particular golfer's technique. Accordingly, when fitting the golfer for a driver, various driver lofts (step 324), head types (step 326), and club head centers of gravity (step 328) can be tested to arrive at an optimal driver ball flight characteristic. In addition, different ball types can be tested in step 330 to optimize distance when using the driver. Different ball types have different spin rates, which should be matched to the launch angle and the ball speed. For example, a higher spin rate can cause the ball to get higher in the air off the club face, which can reduce distance. On the other hand, in certain instances a golfer may need to increase the spin rate in order to gain distance. Thus, the object of step 330 is to find the optimum spin characteristics for a particular golfer's ball flight trajectory and other characteristics. Often, the objective in driver fitting is to maximize distance, control, and consistency. Fitting the golfer to the appropriate shaft flex, driver lofts, shaft weights, ball type, club head type, center of gravity of club head, and shaft bend profiles can be intended to achieve as high a ball velocity as possible coupled with the appropriate launch angle and spin rate.

It should be noted that the process of FIG. 3 can be repeated for all of the golfer's clubs including the driver, fairway woods, irons, wedges, and putters. Each type of golf club results in a unique set of issues that have to be addressed, or optimized during the club fitting process. For the fairway woods and irons, for example, the target often is to have each club hit a certain distance with a high degree of repeatability. For the irons, each consecutive club in the set should have a distance gap between it and the next club so the golfer can easily achieve hitting the ball from any distance to the target. Thus, the goal is more directed toward tight dispersion and distance control rather than just distance. Therefore, the lofts of each club need to be set at the appropriate amount.

For wedges, the objective is to be able to achieve various types of short game shots. Some types of shots require maximum spin while others require higher launch angles. The fitting process of FIG. 3 can be tailored to achieve performance evaluation for various wedge types that will optimize lofts, flanges, bounce angles, and other features necessary to master various shots that can be encountered by the golfer.

Several techniques can be used to further optimize the club fitting process. For example, an optimum launch angle and spin rate can result in a ball flight that is too high, resulting in a loss of control. Thus, a maximum ball height can be used as a ceiling for the ball flight characteristics when testing various equipment in steps 308–330. For example, a good maximum ceiling height for the ball to fly during a drive is 125 feet. So the goal can be to get as high a launch angle and as low a backspin as possible as long as the ball flight is less than 125 ft. A trajectory model can then be used to predict the peak height a ball flies for a given launch condition, as determined in steps 302–306. A relationship that limits the launch angle and backspin for a given ball velocity so that the peak is less than 125 feet is then used when fitting the golfer with equipment. It should be noted that the maximum ceiling might change from golfer to golfer depending on the altitude and standard weather conditions of the golf course that the golfer typically plays.

Further, the process of constantly changing aspects, i.e., shaft, ball, club head. etc., and deriving new information each time can be very time consuming. To reduce the time required, a special type of club head can be used. For example, a driver head that can be manufactured to have the same dimensions but different centers of gravity can be configured so that the driver head can be quickly assembled onto a driver shaft. Different shafts, i.e., shafts of different materials, lengths, gram weights, torques, etc., and with different types of grips and grip weights can then be maintained and configured to quickly assemble onto the driver head.

For example, in one embodiment, the driver head can be configured to quickly snap, or twists onto the end of a shaft. The driver head can be further configured to work in conjunction with a fastener to ensure that the driver head stays on the shaft during testing. In one implementation, for example, a screw, such as an Alan Head screw, can be inserted through a hole in the driver head and down into the shaft. The screw can then be tightened to ensure the driver head remains secured to the shaft.

Thus, a stable of different shafts comprising different characteristics, and of different driver club heads, comprising different loft angles and centers of gravity, can be maintained so that they can be quickly assemble to create drivers with various characteristics for use, for example, during the fitting process of FIG. 3. It should be apparent that similar techniques can be extended to other clubs as well.

In step 332, the lie angle of the golfer's clubs can be measured using, e.g., impact tape on the bottom of each club. This is often done for the irons and wedges. Thus, in step 332, the golfer can take equipment comprising characteristics derived at steps 302–330 and hit balls using the tape. The impact tape can help determine if the club head is in a "toe-up" or "toe-down" position at impact. Adjustments in the lie angle can then be made until the golfer is striking the ball constantly with the "sweet-spot" of the club face.

At this point, all of the information needed to fit the golfer with equipment that will result in optimum performance should be known and parameters associated with, or identifying, the optimum equipment can be derived in step 334.

In certain embodiments, the parameters of step 332 can be used to identify specific clubs, and manufacturers, that should work well for the golfer. The parameters can then be forwarded directly to the manufacturer as part of an order for customized clubs. Then, when the customized clubs arrive, they can be checked using the parameters to make sure they are right and adjusted or returned as required.

Figure 4:
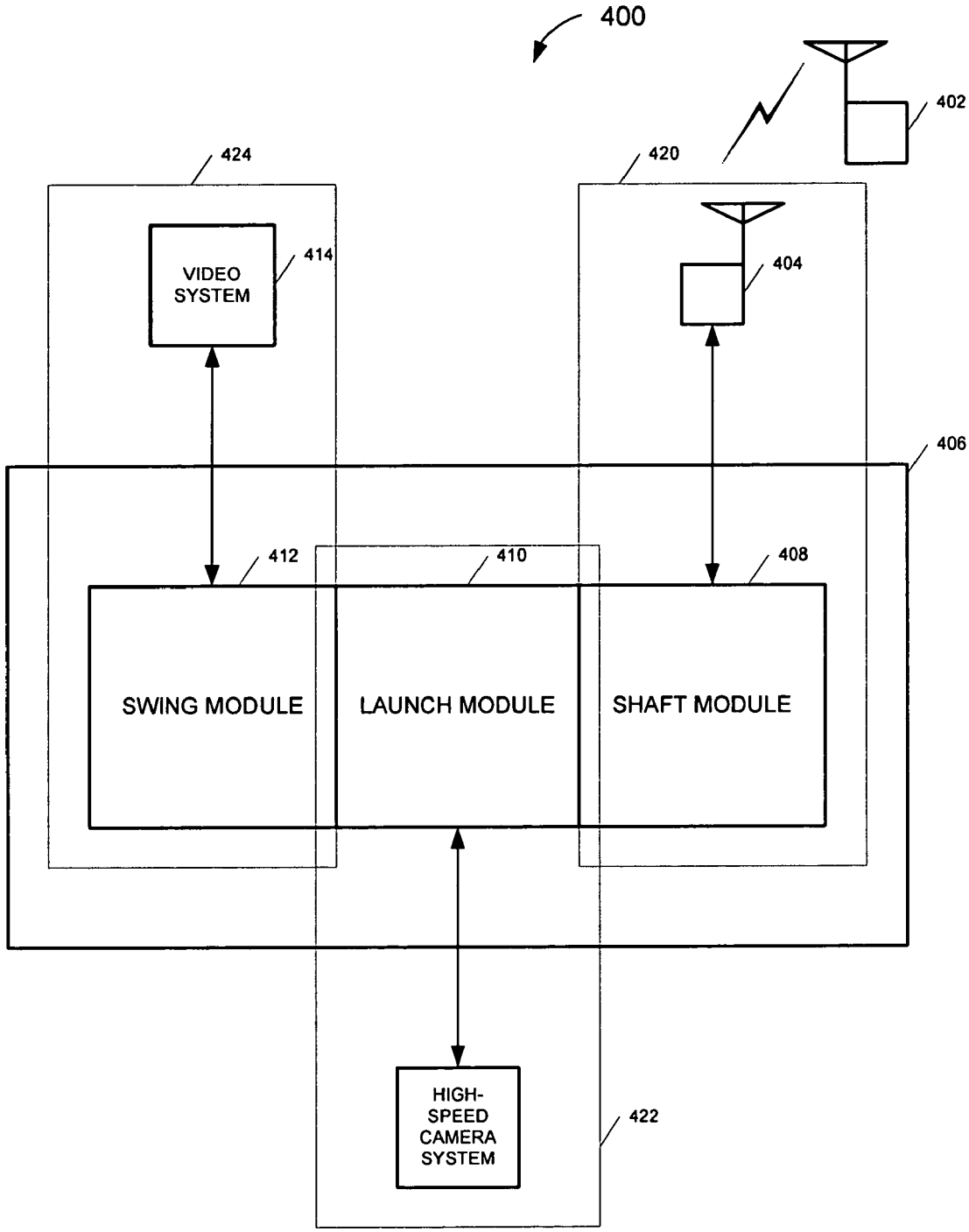
FIG. 4 is a diagram illustrating example components that can comprise a golf equipment fitting system configured in accordance with one embodiment of the invention.

FIG. 4 is a diagram of a golf equipment fitting system configured in accordance with one embodiment of the systems and methods described herein. In the example of FIG. 4, system 400 comprises three main components: a shaft-fitting component 420; a launch fitting component 422 and a swing assessment component 424. In one embodiment, shaft-fitting component 420 comprises a shaft module 408 and a wireless receiver 404. Wireless receiver 404 can be configured to receive swing data from a wireless transmitter 402, which can be interfaced with strain gauges coupled to a golf club shaft being swung by the golfer.

In conventional shaft fitting systems, strain gauges are often wired to a system that collects swing data from the strain gauges. The wires, however, can get in the way and impede the golfer's natural swing and thereby compromise the swing data being collected. Using a wireless interface can help eliminate this problem. In certain embodiments, wireless transmitter 402 can be interfaced with several strain gauges disposed along the shaft of the golf club. Often, the strain gauges are disposed inside the shaft itself. Wireless transmitter 402 can, for example, be coupled with a strap configured to strap the transmitter to the golfer's wrist. In such an implementation, there can be wires coming from the end of the shaft to the wireless transmitter, which is strapped to the golfer's wrist. Thus, it is important to use enough wire so that wireless transmitter 402 does not interfere with the golfer's swing.

In an alternative embodiment, each strain gauge can be comprise its own wireless transmitter 402. For example, a strain gauge and wireless transmitter 402 can be included in a single device installed inside the shaft. Alternatively, one or more wireless transmitter can be inserted into the shaft, or otherwise disposed on the shaft and interfaced with one or more strain gauges.

Swing data collected from the strain-gauged clubs, e.g., via wireless receiver 404, can be used to help approximate the proper shaft flex and tip section recommendations as describe above. The strain-gauged clubs not only measure how the shaft is loaded but also the deflection of the shaft during the swing. The collected swing data is then sent to shaft module 408 for processing in accordance with the system sand methods described herein. The processed data can then be turned into shaft recommendations. For example, the peak deflection during the downswing can indicate the proper shaft flex for the golfer. The higher the peak load or deflection, the more stiff a shaft the golfer may need, e.g., a golfer with a peak deflection of greater than 4.5" can need a shaft that is S or X flex. A golfer with a peak deflection of <3", on the other hand, can need a L, A, or R flex shaft. All others can need an R or S flex shaft. Also, the thrust velocity of the shaft through impact can be determined by shaft module 408 and used to determine an approximate shaft tip recommendation. A golfer with a relatively high thrust velocity of greater than 5 mph, for example, can be biased toward a stiffer shaft.

Additional information such as a lead or lag deflection or a toe up or tow down deflection can be derived from the strain gauges. Such information can indicate flaws in the golfer's swing and therefore may be addressed earlier in the process, or they can indicate golf equipment recommendations. Ultimately, an appropriate ratio of butt flex to tip flex, gram weight, and length can be determined by shaft module 408 using the swing data collected via wireless receiver 404.

Launch fitting component 422 can, in one embodiment, comprise a high-speed camera system 416 and a launch module 410. High-speed camera system 416 can, for example, comprise a color CCD camera combined with a strobe unit. Conventional launch fitting systems often employ black and white cameras; however, this can limit the effectiveness of the club fitting process, because the spin information obtained for the golf ball after club impact can be less accurate than required. This is because the software configure to process the black and white images cannot always obtain the requisite information with the accuracy required due to the nature of the black and white images.

By using a color high-speed camera, more accurate, or more reliable launch data can be obtained. For example, because a color high-speed camera is used, markings comprising two or more different colors, e.g., blue and red, can be placed on the golf ball and used to derive spin information. Images can, for example, be acquired by firing the strobe as the golf ball is impacted and is launched from the clubface. High-speed camera system 416 can then be configured to acquire two images during this period. The two different color markings will be in a certain position in the first image, but will have changed positions in the second image according to the spin of the golf ball as well as the trajectory of the golf ball.

Using digital signal processing techniques, for example, launch module 410 can be configured to derive the spin and launch information from the images capture by high-speed camera system 416. It should be apparent that in a black and white system, the markings may not be easily discernable, thus rendering the information gathered in conventional systems less accurate.

Swing assessment component 424 can comprise a video system 414 and a swing module 412. Video system 414 can comprise one or more video cameras, or one or more high-speed cameras, depending on the implementation. For example, one video camera can be placed in front of the golfer and one can be positioned down the target line of the golfer's swing. Images captured by the cameras are sent to swing module 412, which can process them and save them into a storage medium. The images can then be pulled up and displayed. The images can be allowed to run, i.e., like a video stream so that the golfer can view his swing. The images can then be used to assess the golfer's swing in association with the information being gathered and displayed by shaft module 408 and launch module 410. To help in the assessment, it can be preferable to allow the images to be paused, rewound, fast forwarded, etc.

It will be understood that shaft module 408, launch module 410, and swing module 412 can comprise the requisite hardware, software, or combination thereof required to implement the functions described above. Thus, each module can comprise a standalone system. In alternative embodiments, however, each module can comprise part of a larger system 406. For example, each module can comprise part of a software program loaded onto a single computer system. An exemplary computer system is described in more detail below. But it should be noted that such a computer system can comprise customized hardware or software components or interfaces as required by a particular module.

Figure 6:
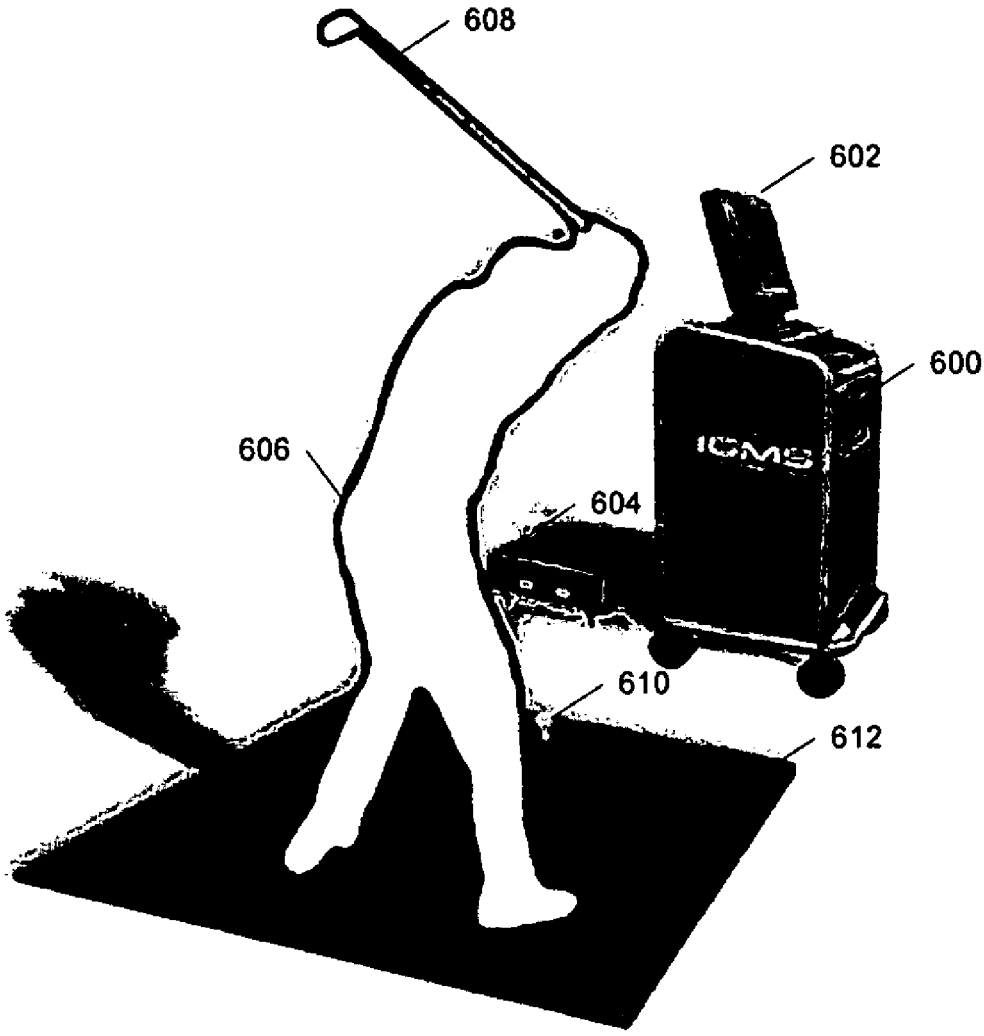
FIG. 6 is a diagram illustrating an implementation of the system of FIG. 4 and the methods of FIGS. 1, 2, and 3.
Figure 7:
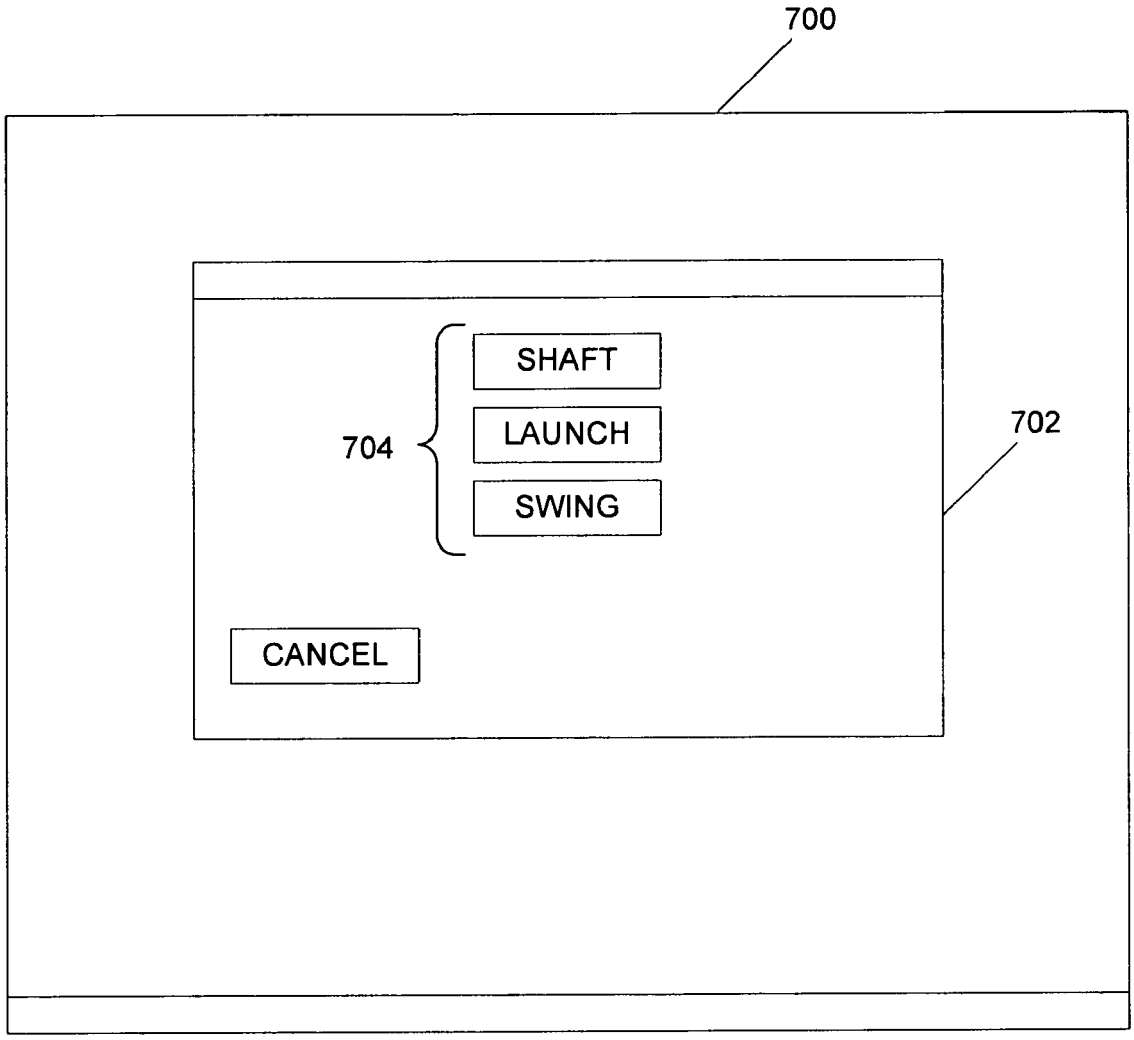
FIG. 7 is a screen shot illustrating an example opening screen that can be displayed by the system of FIG. 4 to a user preparing to implement the methods of FIGS. 1, 2, and 3.

For example, as illustrated in FIG. 6, system 400 can be adapted so that it can be included in a kiosk 600 with a display 602 for displaying the information as described above. Thus, kiosk 600 can comprise a computer system configured to implement the functionality of shaft module 408, launch module 410, and swing module 412. As can be seen, a golfer 606 can stand on a mat 612 and make several swings. The computer system included in kiosk 600 can then receive swing data from strain gauges disposed on shaft 608. Launch data can be obtained from high-speed camera 604. The computer system can process the received data and generate information to be displayed on display 602.

Thus, for the first time launch information can be easily and readily combined with other information, such as that provided by shaft module 408 to more effectively fit the golfer with equipment. Moreover, images of the golfer's swing can be acquired by swing module during the fitting process and used evaluate the golfer's swing. In this manner, flaws in the golfer's swing, e.g., as indicated by the launch or swing data collected by launch module 410 and shaft module 408 respectively, can be viewed and hopefully corrected using the images captured and displayed by swing analysis component 424. Having all three components 420, 422, and 424 available in the same system 400 makes fitting easier and more effective. Further, as explained below, system 400 can be configured to allow a user to access information form each component 420, 422, and 424 as required during the fitting process. This makes fitting even more efficient and effective.

FIGS. 7–13 are screen shots illustrating various screens that can be displayed on display 602. Thus, in FIG. 7 a screen shot of an opening screen 700 that can be displayed when a user, i.e., a golf pro preparing to fit a golfer with golf equipment, can see when they first run the software loaded onto the computer system included in kiosk 600. In screen 700, a selection window 702 is displayed that allows the user to access one of several functions, e.g., via radio buttons 704.

The user can, for example, proceed past opening screen 700 by electing to start a new fitting process using radio buttons 704. This can cause a shaft module screen 800, such as the one illustrated by the screen shot of FIG. 8, to be displayed to the user. Shaft module screen 800 can be used to display the information generated by shaft module 408. Thus, screen 800 can include a graphical display area 802 configured to display information related to the loading of a shaft being swung by a golfer being fitted for golf equipment using, e.g., kiosk 600. The information displayed in area 802 can comprise curves, such as those depicted in FIGS. 5A through 5D, for each swing. The curves being displayed in area 802 can be used to assess the golfer's swing in order to help the golfer make needed swing improvements to optimize the fitting process.

Figure 8:
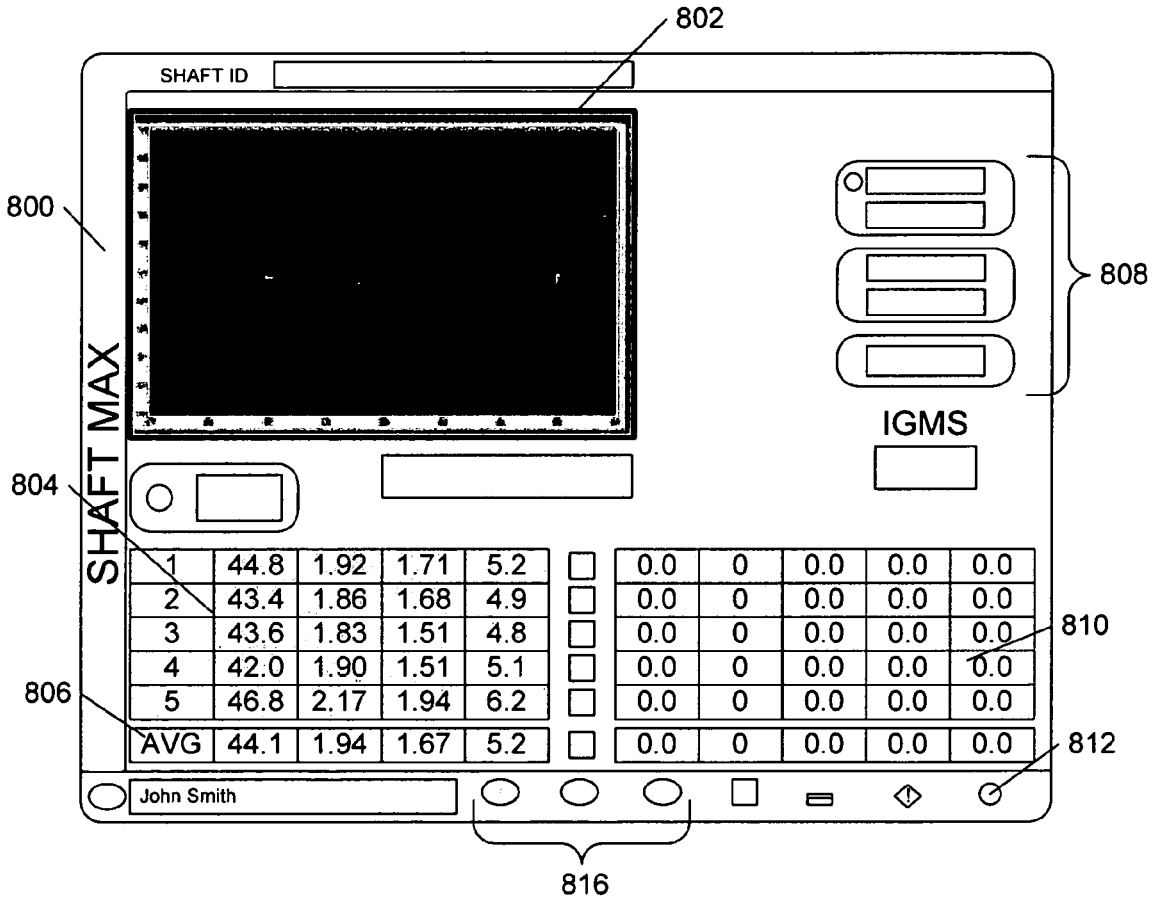
FIG. 8 is a screen shot illustrating an example shaft module screen that can be displayed by the system of FIG. 4 when implementing the method of FIG. 2.

Additionally, screen 800 can include a table 804 in which swing parameters, e.g., time, peak flex, ramp potential, and corresponding flex, derived for each swing can be displayed. In the example of FIG. 8, data can be displayed for the previous 5 swings. The bottom row 806 of table 804 can be used to display averages for the values displayed in the table. The average values can be used, for example, to make shaft recommendations for use in the rest of the fitting process as described above and as further illustrated below.

Screen 800 can also include a table 810 that can be used to display information obtained during launch analysis described below. Thus, the user can have launch analysis information available in order to help the user recommend a shaft or analyze the golfer's swing. As can be seen, in the example of FIG. 8, the launch data for the previous 5 swings can be displayed in table 810. Further, screen 800 can include a toolbar 812, with radio buttons 816 that allow the user to quickly jump from shaft module screen 800 to the launch module screen 900 and to swing module screen 1100. Screens 900 and 1100 are described below, but the ability to quickly access these screens allow the user to more effectively use all the tools available to analyze the golfer's swing in order to arrive at an optimal equipment fitting recommendation.

Figure 9:
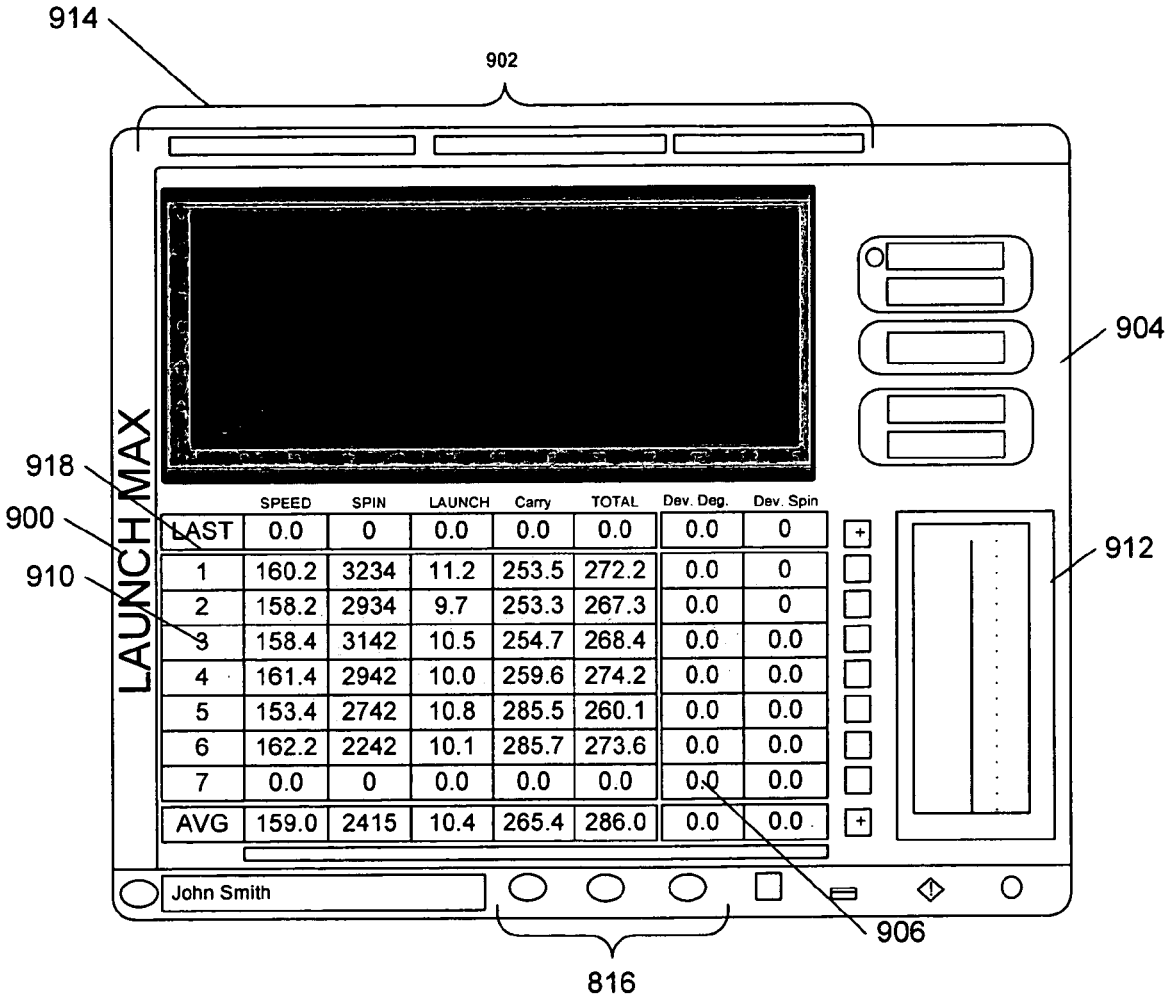
FIG. 9 is a screen shot illustrating an example launch module screen that can be displayed by the system of FIG. 4 when implementing the method of FIG. 3.

Screen 900, illustrated in the screen shot of FIG. 9, can actually be displayed by launch module 410 while launch data is being gathered. Thus, screen 900 can comprise a table 910 for displaying the launch information being derived, e.g., ball speed, spin, launch angle, carry distance, and total distance. Additionally, table 910 can comprise columns 906 for data related to the deviation of the ball flight from the center, or target line. Thus, columns 906 can be used to display a deviation from the centerline in degrees as well as side spin information.

Table 910 can also include a row 918 in which averages for the values displayed in table 910 can be displayed. For example, in the embodiment of FIG. 9, column 918 is used to display averages for the previous 7 swings. The information from table 910 can then be propagated to screen 800 in table 810. Thus, depending on the number of columns in table 910, some or all of the launch data from screen 900 can also be displayed in screen 800, with the ability to quickly jump from one screen to the other using radio buttons 816.

Screen 900 can also include a graphic data area 914 for displaying graphical information related to ball flight as derived, e.g., by launch module 410. Thus, a graph of the ball fight illustrating height, e.g., in feet, and distance, e.g., in yards, can be displayed in area 914. Additionally, another graphical area 912 can be included to graphically illustrate the deviation from the centerline. Thus, area 912 can be configured to graphically illustrate a distance, e.g., in yards, and a deviation, e.g., in degrees. Radio control buttons 904 can be included to allow the user to graphically display, in areas 914 and 912, data for each swing, a particular swing such as the last swing, the average of all swings, etc. Similar control buttons 808 can be included in screen 800.

Screen 900 can also include a tool bar 902 in which information related to the equipment currently being used can be displayed. Thus, the golfer can make a few swings and launch data can be gathered and displayed on screen 900. Based on the information, the user can suggest equipment changes, i.e., a lower spinning ball, a stiffer shaft, etc. and new data can be acquired and displayed. Each time equipment, or aspects of the equipment, is changed, the information in toolbar 902 can be updated. This way, neither the user, nor the golfer, is required to remember what equipment they are currently using. This is helpful, because the golfer can make several equipment changes, based on the launch information being collected and displayed, until an optimum ball flight is achieved.

Figure 10:
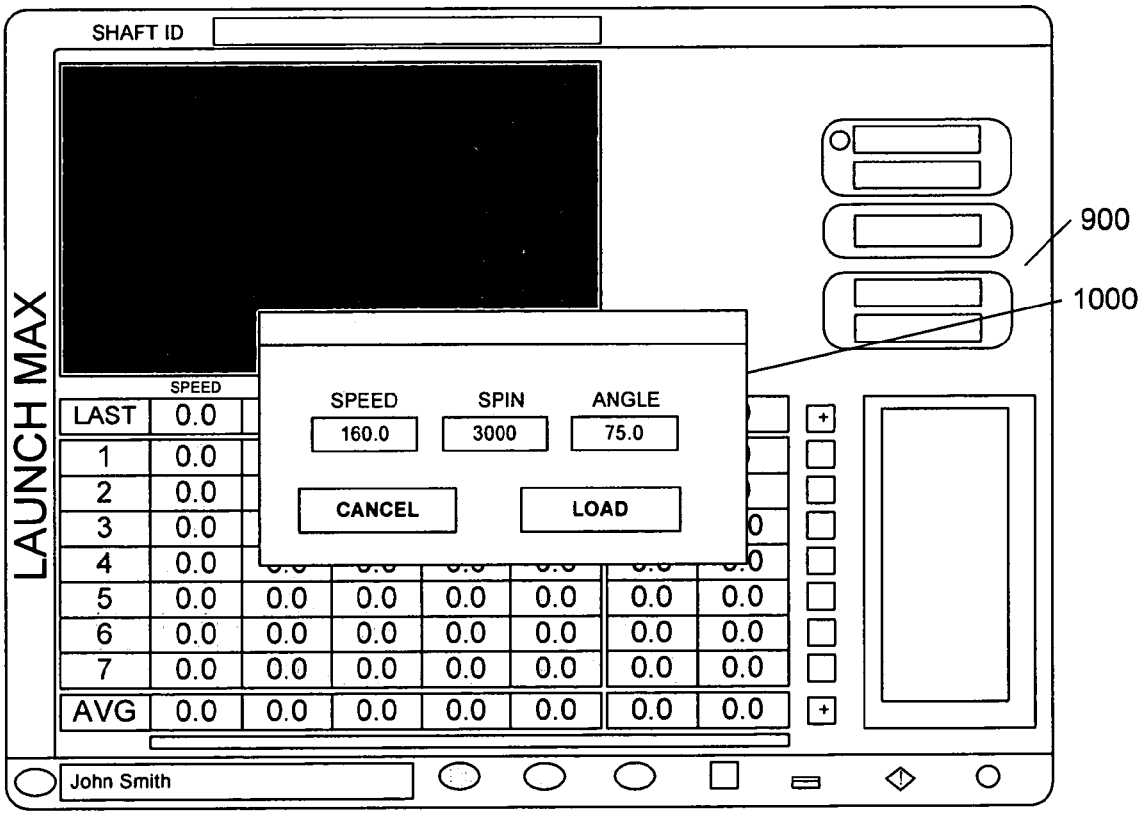
FIG. 10 is a screen shot illustrating an example optimization screen that can be displayed by the system of FIG. 4 to optimize the data collected during implementation of the method of FIG. 3.

A launch optimization screen 1000, as illustrated in FIG. 10, can even be invoked to help optimize the launch data being collected. Thus, for example, launch optimization screen can be used to quickly assess the optimum launch conditions for a certain golfer based on information collected by launch module 410.

Figure 11:
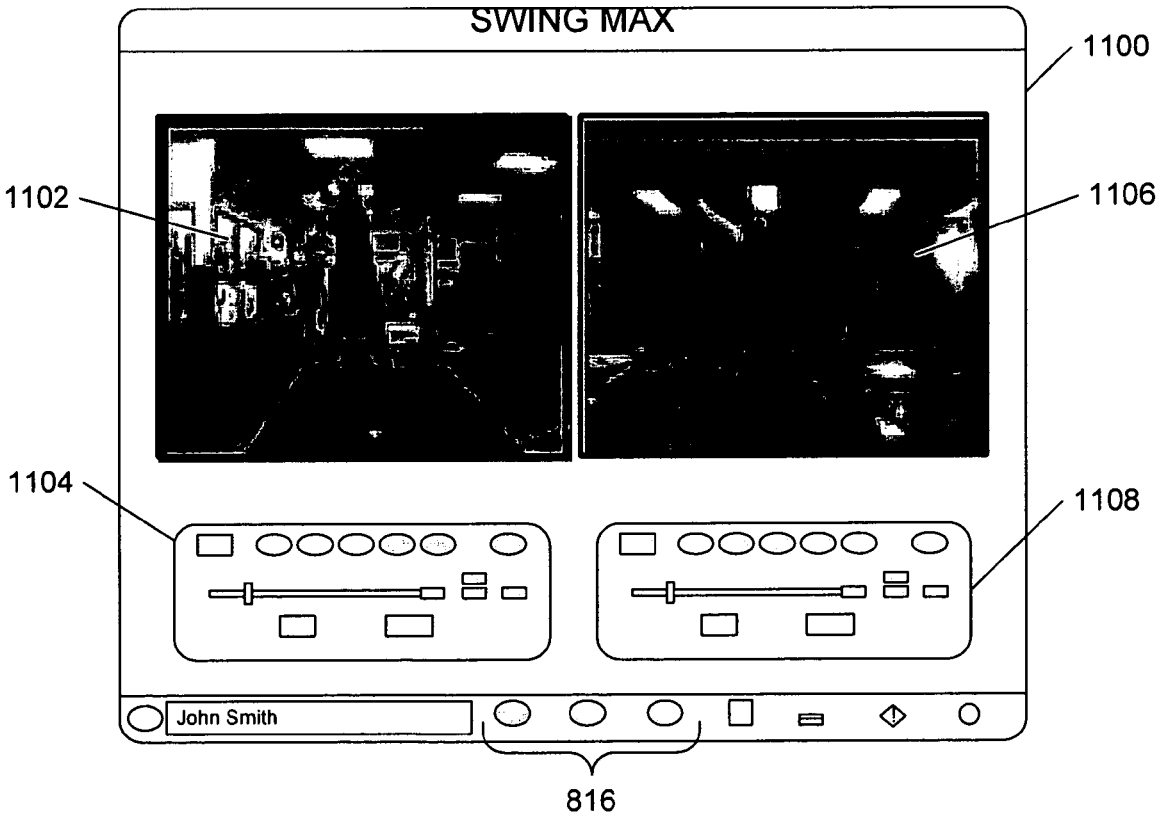
FIG. 11 is a screen shot illustrating an example swing module screen that can be displayed by the system of FIG. 4 when implementing the methods of FIGS. 1, 2, and 3.

Swing module screen 1100, an example of which is illustrated by the screen shot of FIG. 11, can be included to allow the user and the golfer to view the images captured by video system 414 and processed by swing module 412. Screen 1100 can, as illustrated in the example of FIG. 11, comprise two halves, with each half comprising a video display area 1102 and 1106 and control areas 1104 and 1108 respectively. In FIG. 11, the controls comprising control area 1104 can be used to play, freeze, rewind, fast forward, etc. the images being displayed in video display area 1102 in much the same way VCR controls work. Video display area 1106 can display real time images. The images being displayed can, in certain embodiments, be switched from one camera making up video system 414 to the next. Further, in certain embodiments, one half of screen 1000 can be used to display images from one camera, while the other half is use to display images from another camera.

Figure 12:
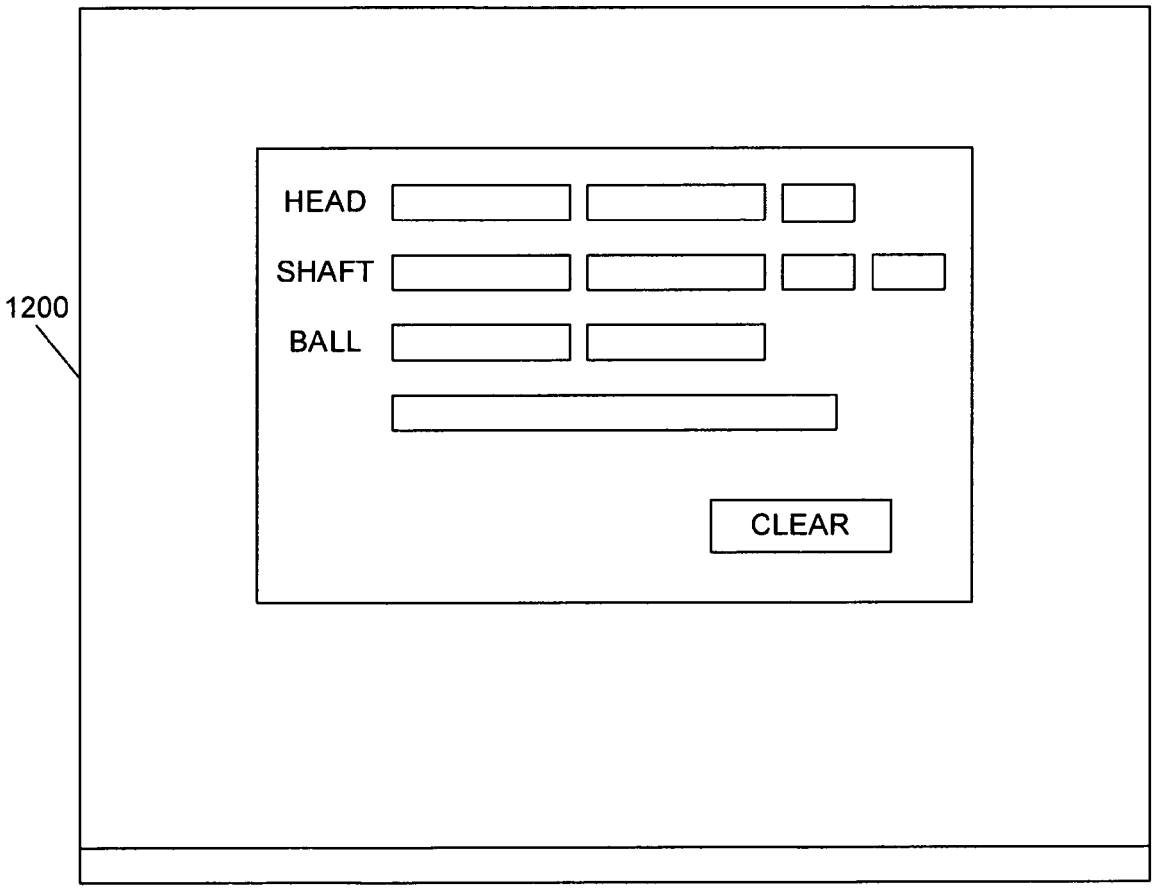
FIG. 12 is a screen shot illustrating an example launch options screen that can be displayed by the system of FIG. 4 when implementing the method of FIG. 3.
Figure 13:
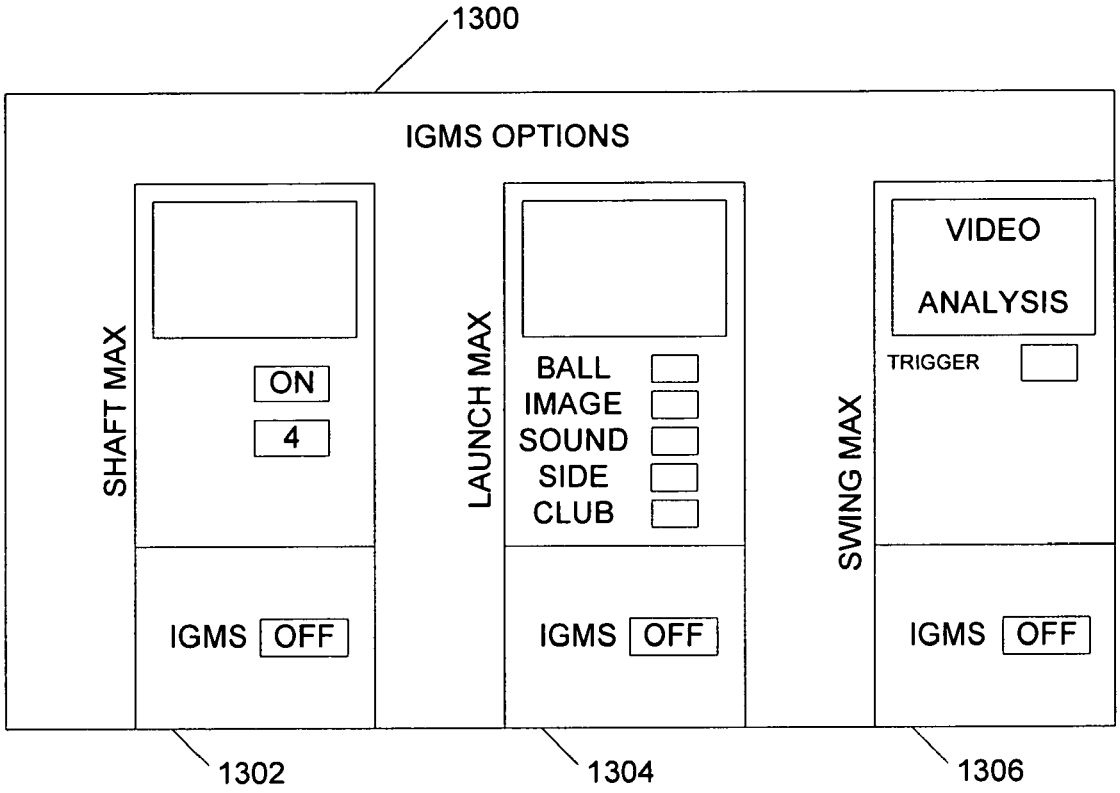
FIG. 13 is a screen shot illustrating an example systems options screen that can be displayed by the system of FIG. 4 when implementing the method of FIG. 1.

Launch options screen 1200, illustrated by the example screen shot of FIG. 12, can be used to enter information about the equipment presently being used in conjunction with gathering launch data to be displayed in screen 900.

Options screen 1300 can be included to display information related to each of screen 800, 900, and 1100 simultaneously. Thus, screen 1300 can comprise a shaft area 1302 in which controls for the operation of shaft module 408 can be manipulated. Similarly, screen 1300 can comprise launch area 1304 and swing area 1306 in which controls for the operation of launch module 410 and swing module 412, respectively, can be manipulated.

Figure 14:
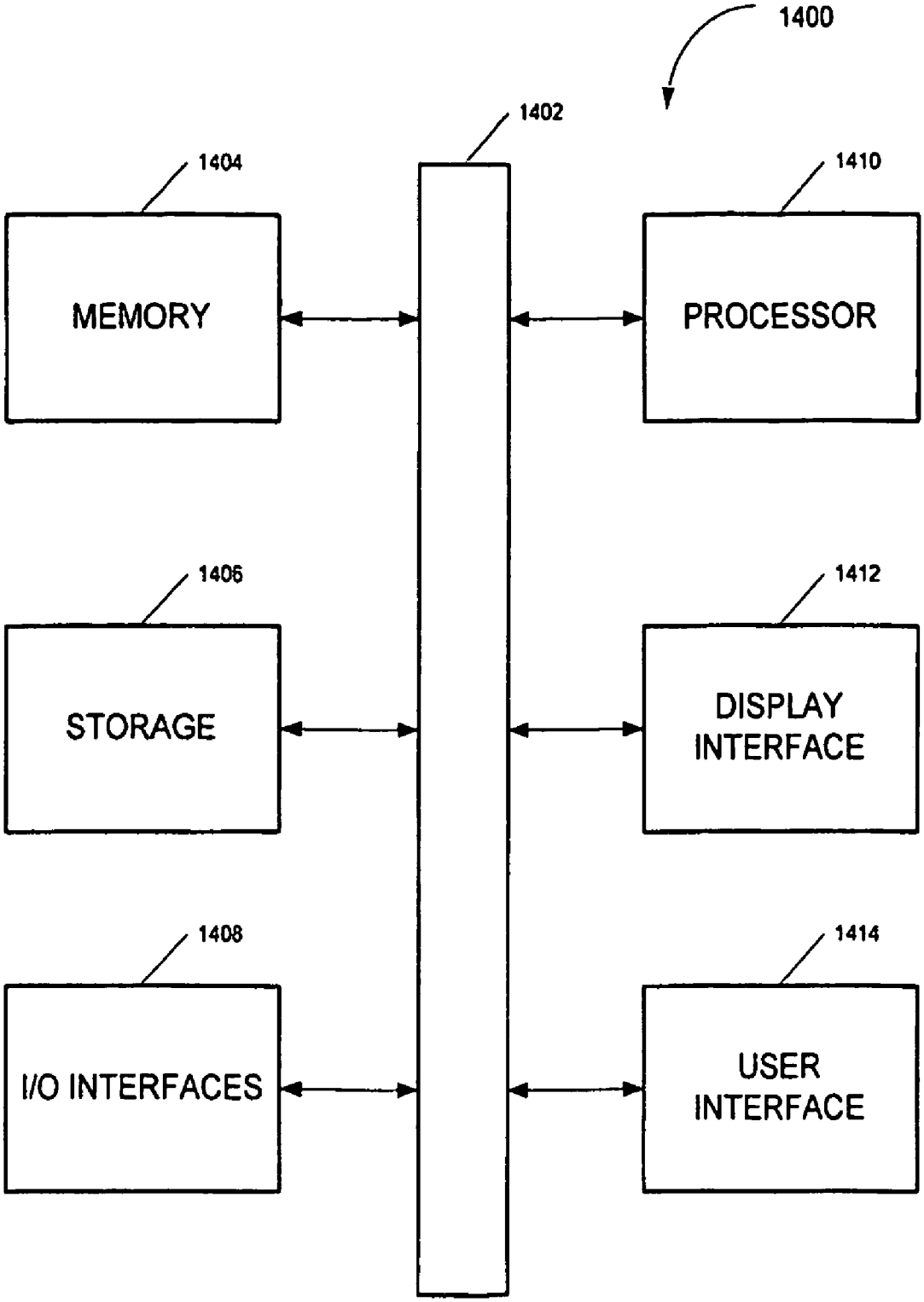
FIG. 14 is a logical block diagram illustrating an exemplary computer system that can be that can be used to implement the system of FIG. 4.

Thus, the fitting processes and techniques described above can be implemented via a kiosk, such as kiosk 600, using screens such as those just described. As mentioned, modules 408, 410, and 412 can be implemented as software modules, possibly with associated specialized hardware interfaces, within a computer system in kiosk 600. In other words, kiosk 600 can comprise a computer system loaded with software modules 408, 410, and 412. FIG. 14 is a logical block diagram illustrating an example embodiment of a computer system 1400 that can be used to implement the system of FIG. 4.

As will be understood, some type of processing system is always at the heart of any computer system, whether the processing system includes one or several processors included in one or several devices. Thus, computer system 1400 of FIG. 14 is presented as a simple example of a processing system. In the example of FIG. 14, computer system 1400 comprises a processor 1410 configured to control the operation of computer system 1400, memory 1404, storage 1406, a Input/Output (I/O) interfaces 1408, a display output 1412, a user interface 1414, and a bus 1402 configured to interface the various components comprising computer system 1400.

Processor 1410, in one embodiment, comprises a plurality of processing circuits, such as math coprocessor, network processors, digital signal processors, audio processors, etc. These various circuits can, depending on the embodiment, be included in a single device or multiple devices. Processor 1410 also comprise an execution area into which instructions stored in memory 1404 are loaded and executed by processor 1410 in order to control the operation of computer system 1400. Thus, for example, by executing instructions stored in memory 1404, processor 1410 can be configured to implement the functionality of modules 408, 410, and 412.

Memory 1404 can comprise a main memory configured to store the instructions just referred to. In one embodiment, memory 1404 can also comprise a secondary memory used to temporarily store instructions or to store information input into computer system 1400, i.e., memory 1404 can act as scratch memory also. Memory 1404 can comprise, depending on the embodiment, a plurality of memory circuits, which can be included as a single device, or as a plurality of devices.

Storage 1406 can include, in certain embodiments, a plurality of drives configured to receive various electronic media. For example, in one embodiment, storage 1406 includes a floppy drive configured to receive a floppy disk, a compact disk drive configured to receive a compact disk, and/or a digital video disk drive configured to receive a digital videodisk. In another embodiment, storage 1406 can also include disk drives, which can include removable disk drives. The drives included in storage 1406 can be used, for example, to receive electronic media that has stored thereon instructions to be loaded into memory 1404 and used by processor 1410 to control the operation of computer system 1400.

I/O interfaces 1408 can be configured to allow computer system 1400 to interface with devices such as video system 414, high-speed camera system 416, and receiver 404. Thus, I/O interface 1408 can comprise the interface hardware required to receive signals from the various components used to collect the data used by modules 408, 410, and 412.

Display interface 1412 can be configured to allow computer system 1400 to interface with a display. Thus, computer system 1400 can display the information, described in relation to the example screen shots described above, to a user via display interface 1412.

User interface 1414 can be configured to allow a user to interface with computer system 1400. Thus, depending on the embodiment, user interface 1414 can include a mouse interface, a keyboard interface, an audio interface, etc.

It should be clear that the general description of a computer system provided above is by way of example only and should not be seen to limit implementation of system 400 to any particular computer architecture or implementation. Rather any architecture or implementation capable of implementing the processes and functionality described above can be used to implement the systems and methods described herein.

While certain embodiments of the inventions have been described above, it will be understood that the embodiments described are by way of example only. Accordingly, the inventions should not be limited based on the described embodiments. Rather, the scope of the inventions described herein should only be limited in light of the claims that follow when taken in conjunction with the above description and accompanying drawings.

What is claimed:

1. A method for fitting golf equipment, comprising:

marking a golf ball with color markings, the color markings comprising at least two colors; and collecting data related to how the golfer's swing launches a golf ball using a color camera and the color markings.

2. The method of claim 1, further comprising specifying golf equipment based on the collected launch data.

3. The method of claim 1, wherein the collected data comprises data related to the spin of a golf ball hit by the golfer.

4. The method of claim 1, wherein the collected data comprises data related to the speed of a golf ball hit by the golfer as the golf ball leaves the face of the club swung by the golfer.

5. The method of claim 1, wherein the collected data comprises data related to the launch angle of a golf ball hit by the golfer as the golf ball leaves the face of the club swung by the golfer.

6. The method of claim 1, wherein collecting data comprises converting images of the color markings on the golf ball captured by the color camera into spin, speed, and launch angle data.

7. The method of claim 1, further comprising deriving ball flight characteristics based on the collected data.

8. The method of claim 7, further comprising displaying information related to the derived ball flight characteristics.

9. The method of claim 7, wherein the derived ball flight characteristics comprise carry distance, total distance, and height characteristics.

10. The method of claim 1, further comprising averaging collected data for a plurality of swings and specifying golf equipment based on the averaged launch data.

11. A method for fitting golf equipment, comprising:

deriving an optimum launch model;

collecting data related to how the golfer's swing launches a golf ball, wherein the golf ball is marked with color markings, the color marking comprising at least two colors; and the data is collected using a color camera and the color markings; and specifying golf equipment based on the collected launch data and derived optimum launch model.

12. The method of claim 11, wherein the collected data comprises data related to the spin of a golf ball hit by the golfer.

13. The method of claim 11, wherein the collected data comprises data related to the speed of a golf ball hit by the golfer as the golf ball leaves the face of the club swung by the golfer.

14. The method of claim 11, wherein the collected data comprises data related to the launch angle of a golf ball hit by the golfer as the golf ball leaves the face of the club swung by the golfer.

15. The method of claim 11, wherein collecting data comprises converting images of color markings on the golf ball captured by a color camera into spin, speed, and launch angle data.

16. The method of claim 11, further comprising deriving ball flight characteristics based on the collected data.

17. The method of claim 16, further comprising displaying information related to the derived ball flight characteristics.

18. The method of claim 16, wherein the derived ball flight characteristics comprise carry distance, total distance, and height characteristics.

19. The method of claim 11, further comprising averaging collected data for a plurality of swings and specifying golf equipment based on the averaged launch data.

20. The method of claim 11, wherein deriving an optimized launch model comprises determining an optimum trajectory height limitation.

21. The method of claim 20, wherein deriving an optimum launch model further comprises deriving a relationship between golf ball velocity, launch angle, and spin of the golf ball that will result in an optimum golf ball trajectory without exceeding the optimum trajectory height limitation.

22. The method of claim 21, wherein the relationship is derived in a manner that maximizes launch angle and reduces spin for a given velocity.

23. A golf equipment fitting system, comprising:

a color camera; and a launch module configured to collect data related to how the golfer's swing launches a golf ball marked with at least two color markings using the color camera and the color markings.

24. The golf equipment fitting system of claim 23, wherein the collected data comprises data related to the spin of a golf ball hit by the golfer.

25. The golf equipment fitting system of claim 23, wherein the collected data comprises data related to the speed of a golf ball hit by the golfer as the golf ball leaves the face of the club swung by the golfer.

26. The golf equipment fitting system of claim 23, wherein the collected data comprises data related to the launch angle of a golf ball hit by the golfer as the golf ball leaves the face of the club swung by the golfer.

27. The golf equipment fitting system of claim 23, wherein the launch module is configured to convert images of the color markings on the golf ball captured by the color camera into spin, speed, and launch angle data.

28. The golf equipment fitting system of claim 23, wherein the launch module is further configured to derive ball flight characteristics based on the collected data.

29. The golf equipment fitting system of claim 28, further comprising a display, and wherein the launch module is further configured to display information related to the derived ball flight characteristics.

30. The golf equipment fitting system of claim 28, wherein the derived ball flight characteristics comprise carry distance, total distance, and height characteristics.

31. The golf equipment fitting system of claim 23, wherein the launch module is further configured to average collected data for a plurality of swings.

* * * * *

UNITED STATES PATENT AND TRADEMARK OFFICE

CERTIFICATE OF CORRECTION

PATENT NO. : 7,159,451 B2
APPLICATION NO. : 10/722585
DATED : January 9, 2007
INVENTOR(S) : Timothy J. McGann et al.

It is certified that error appears in the above-identified patent and that said Letters Patent is hereby corrected as shown below:

Title Page, item [73] should read --Assignee: Max Out Golf, LLC., Sherman Oaks, California--

Signed and Sealed this

Fourth Day of September, 2007

JON W. DUDAS
*Director of the United States Patent and Trademark Office*